United States Patent [19]

Gray

[11] 4,378,300

[45] Mar. 29, 1983

[54] PEROXYGEN BLEACHING COMPOSITION

[75] Inventor: Frederick W. Gray, Summit, N.J.

[73] Assignee: Colgate-Palmolive Company, New York, N.Y.

[21] Appl. No.: 329,534

[22] Filed: Dec. 10, 1981

[51] Int. Cl.[3] ..... C11D 7/18; C11D 3/39; C11D 7/56

[52] U.S. Cl. ..... 252/99; 252/95; 252/102; 252/103; 252/174.16; 252/174.24; 252/186.31; 252/186.27

[58] Field of Search ..... 252/95, 99, 102, 103, 252/174.16, 174.24, 186

[56] References Cited

U.S. PATENT DOCUMENTS

| | | | |
|---|---|---|---|
| 3,338,839 | 8/1967 | MacKellar et al. . | |
| 4,225,452 | 9/1980 | Leigh . | |
| 4,259,200 | 3/1981 | Sims et al. | 252/102 |

*Primary Examiner*—John E. Kittle
*Assistant Examiner*—Robert A. Wax
*Attorney, Agent, or Firm*—Bernard Lieberman; Murray M. Grill; Herbert S. Sylvester

[57] ABSTRACT

A bleaching and laundering composition comprising a peroxygen compound, an activator comprising phthalic anhydride and diethylene triamine pentamethylene phosphonic acid and/or a water-soluble salt thereof. A method of bleaching and laundering soiled and/or stained materials with the aforesaid bleaching composition is also described.

11 Claims, No Drawings

PEROXYGEN BLEACHING COMPOSITION

BACKGROUND OF THE INVENTION

This invention relates, in general, to bleaching and laundering compositions and their application to laundering operations. More specifically, this invention relates to bleaching and laundering compositions containing a peroxygen compound, an organic activator for said peroxygen compound comprising phthalic anhydride and a defined phosphonate compound.

Bleaching compositions which release active oxygen in the laundry solution are extensively described in the prior art commonly used in domestic laundering operations. In general, such bleaching compositions contain peroxygen compounds, such as, perborates, percarbonates, perphosphates and the like which promote the bleaching activity by forming hydrogen peroxide in aqueous solution. A major drawback attendant to the use of such peroxygen compounds is that they are not optimally effective at the relatively low washing temperatures employed in most household washing machines in the United States, i.e., temperatures in the range of 80° to 130° F. By way of comparison, European wash temperatures are generally substantially higher extending over a range, typically, from 90° to 200° F. However, even in Europe and those other countries which generally presently employ near boiling washing temperatures, there is a move to lower temperature laundering.

In an effort to enhance the bleaching activity of peroxygen bleaches, the prior art has employed materials called activators in combination with the peroxygen compounds. It is generally believed that the interaction of the peroxygen compound and the activator results in the formation of peroxyacid which is the active species for bleaching. Numerous compounds have been proposed in the art as activators for peroxygen bleaches among which are included carboxylic acid anhydrides such as those disclosed in U.S. Pat. Nos. 3,298,775; 3,338,839 and 3,532,634; carboxylic esters such as disclosed in U.S. Pat. No. 2,995,905; N-acyl compounds such as those described in U.S. Pat. Nos. 3,912,648 and 3,919,102; cyanoamines such as described in U.S. Pat. No. 4,199,466; and acyl sulfonamides such as disclosed in U.S. Pat. No. 3,245,913.

The use of chelating agents in bleaching compositions is described in the patent literature. U.S. Pat. No. 3,243,378 to Stoltz discloses a bleaching composition containing a hypochlorite or peroxide type bleaching material and a chelating agent to sequester metal cations. U.S. Pat. No. 4,225,452 to Leigh discloses the combination of specified classes of chelating agents (among which are phosphonate compounds) with peroxygen compounds and an organic activator for the purpose of suppressing the decomposition of the peroxygen compound in the bleach composition; specifically, inhibiting the unwanted reaction of the peroxygen compound with a peroxyacid to form the corresponding carboxylic acid, oxygen and water. The patentee, however, states that the efficacy of such chelating agents is restricted to certain peroxygen compound/activator systems. Specifically, at column 2, beginning at line 63, the patentee states that certain activators, such as phthalic anhydride, "which form with the percompound in solution a peracid having a double bond between the carbon atoms in the $\alpha,\alpha'$ position to the carbonyl groups of the corresponding anhydride ring", are excluded from use in the bleaching compositions described in the patent because of their instability.

Phthalic anhydride has, however, been disclosed in the art as an activator for peroxygen compounds, although it apparently was ineffective for such purpose. Specifically, U.S. Pat. No. 3,338,839 is directed to a bleaching composition containing as an activator a mixed carboxylic acid anhydride. In Example I of the patent, phthalic anhydride was used as an activator in a comparative test run, the results of which illustrated the ineffectiveness of phthalic anhydride as an activator when used alone, as compared to the mixture of activators used in the bleaching composition of the patent.

SUMMARY OF THE INVENTION

The present invention provides a bleaching composition comprising a peroxygen compound, an activator for said peroxygen compound consisting essentially of phathlic anhydride, and diethylene triamine pentamethylene phosphonic acid and/or a water-soluble salt thereof. The detergent bleaching composition of the invention comprises the above-defined bleaching composition in combination with a surface active detergent, and preferably a detergency builder salt. In accordance with the process of the invention, bleaching of stained and/or soiled materials is effected by contacting such materials with an aqueous solution of the above-defined compositions.

DETAILED DESCRIPTION OF THE INVENTION

The peroxygen compounds useful in the present invention include hydrogen peroxide and compounds that release hydrogen peroxide in aqueous media, such as, alkali metal perborates, e.g., sodium perborate and potassium perborate, alkali metal perphosphates, such as sodium perphosphate and potassium perphosphate, alkali metal persilicates, such as, sodium persilicate and potassium persilicate, and alkali metal percarbonates, such as sodium percarbonate and potassium percarbonate. The alkali metal perborates are usually preferred because of their commercial availability and relatively low cost.

The peroxygen compound is generally present in the bleaching composition relative to the activator in a molar ratio of peroxygen compound to phthalic anhydride of about 1:10 to about 10:1, the preferred ratio being from about 1:2 to about 3:1. It will be appreciated that the concentration of phthalic anhydride will depend on the concentration of the peroxygen compound, which in turn is governed by the degree of bleaching desired. The peroxygen compound is typically present in the bleaching composition in an amount ranging from about 1% to about 50%, by weight, preferably 3% to 25%, and most preferably, 5% to 20%, by weight of the bleaching composition.

The amount of bleaching composition added to the wash solution is generally selected to provide an amount of peroxygen compound within the range corresponding to about 3 to 100 parts of active oxygen per million parts of the wash solution. Thus, a bleach detergent composition intended for use at a concentration of 1.5 g. per liter of wash solution and which contains, for example, 7% of sodium perborate tetrahydrate having an active oxygen (A.O.) content of 10% will provide 10.5 ppm A.O.; similarly, a composition containing 20% of such perborate compound will, under the same conditions of use, provide 30 ppm A.O.

Diethylene triamine pentamethylene phosphonic acid (conveniently referred to herein as "DTPMP") and/or one or more of its water-soluble salts may be employed in the bleaching compositions of the invention. Among the salts of DTPMP, the sodium, potassium and ammonium salts are generally preferred because of their relatively greater solubility and ease of preparation. DTPMP is a known chelating agent but it is believed that its function in the present bleaching composition is more than simply sequestering metallic impurities present in the aqueous media employed in the washing and/or bleaching operation. It apparently increases bleaching efficacy by inhibiting the peroxyacid-consuming side reaction which result in depletion of the active bleaching species which would otherwise be available for useful purposes. In any event, regardless of the actual mechanism of its operation, the presence of DTPMP (or a salt thereof) in combination with the peroxygen compound/activator system of the present invention provides a bleaching solution which consumes less active oxygen than solutions obtained from similar compositions without DTPMP, and yet provides comparable stain removal. The concentration of DTPMP and/or its salt derivatives in the bleaching composition may vary from about 0.1% to about 10%, by weight, of the total composition, but preferably is present in an amount from 0.5% to 2% by weight of the total composition.

The selected peroxygen compound, phthalic anhydride and DTPMP and/or its water-soluble salt may be formulated as a separate bleach product, or alternatively, may be employed in a built detergent composition. Accordingly, the bleaching composition of the invention may include conventional additives used in the fabric washing art, such as, binders, fillers, builder salts, proteolytic enzymes, optical brighteners, fabric softeners, perfumes, dyes, corrosion inhibitors, anti-redeposition agents, foam stabilizers and the like, all of which may be added in varyingquantities depending on the desired properties of the bleaching composition and their compatability with such composition. Additionally, the bleaching compositions of the invention may be incorporated into laundering detergent compositions containing surface active agents, such as, anionic, cationic, nonionic, ampholytic and zwitterionic detergents and mixtures thereof.

When the instant bleaching compositions are incorporated into a conventional laundering composition and are thus provided as a fully-formulated detergent bleaching composition, the latter composition will comprise the following: from about 5 to 50%, by weight, of the instant bleaching composition, from about 5 to 50%, by weight, of a detergent surface active agent, and from about 1 to 60%, by weight, of a detergency builder which can also function as a buffer to provide the requisite pH range when the laundering composition is added to water. The balance of the composition will predominantly comprise filler salts, such as, sodium sulfate and potassium sulfate, minor additives, such as, optical brighteners, perfumes, dyes, anti-redeposition agents and the like, and water.

The anionic surface active agents useful in the present invention include those surface active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate, carboxylate, phosphonate and phosphate so as to form a water-soluble detergent.

Examples of suitable anionic detergents include, for example, the water-soluble salts (e.g., the sodium, ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an alkyl radical containing from about 8 to 26, and preferably from about 12 to 22 carbon atoms. (The term "alkyl" includes the alkyl portion of the higher acyl radicals). Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of 6 to 23 carbons and $R_1$ is an alkyl group containing from about 1 to 17 carbon atoms or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown in U.S. Pat. Nos. 2,503,280; 2,507,088; 3,260,741; 3,372,188; and German Pat. No. 735,096. Other useful sulfate and sulfonate detergents include sodium and potassium sulfates of higher alcohols containing from about 8 to 18 carbon atoms, such as, for example, sodium lauryl sulfate and sodium tallow alcohol sulfate, sodium and potassium salts of alpha-sulfofatty acid esters containing about 10 to 20 carbon atoms in the acyl group, for example, methyl alpha-sulfomyristate and methyl alphasulfotallowate, ammonium sulfates of mono- or di- glycerides of higher ($C_{10}$–$C_{18}$) fatty acids, for example, stearic monoglyceride monosulfate; sodium and alkylol ammonium salts of alkyl polyethenoxy ether sulfates produced by condensing 1 to 5 moles of ethylene oxide with 1 mole of higher ($C_8$–$C_{18}$) alcohol; sodium higher alkyl ($C_{10}$–$C_{18}$) glyceryl ether sulfonates; and sodium or potassium alkyl phenol polyethenoxy ether sulfates with about 1 to 6 oxyethylene groups per molecule and in which the alkyl radicals contain about 8 to 12 carbon atoms.

The suitable anionic detergents also include the $C_8$ to $C_{18}$ acyl sarcosinates (for example, sodium lauroyl sarcosinates), sodium and potassium salts of the reaction product of higher fatty acids containing 8 to 18 carbon atoms in the molecule esterified with isethionic acid, and sodium and potassium salts of the $C_8$–$C_{18}$ acyl N-methyl taurides, for example, sodium cocyl methyl taurate and potassium stearoyl methyl taurate.

Anionic phosphate surfactants in which the anionic solubilizing group attached to the hydrophobic group is an oxyacid of phosphorous are also useful in the detergent compositions. Suitable phosphate surfactants are the sodium, potassium and ammonium alkyl phosphate esters such as $(R—O)_2PO_2M$ and $ROPO_3M_2$ in which R represents an alkyl chain containing from about 8 to 20 carbon atoms and M represents a soluble cation. The compounds formed by including from about 1 to 40 moles of ethylene oxide in the foregoing esters, for example, $[R—O(C_2H_4O)_n]_2\ PO_2M$ are also useful.

The most highly preferred water-soluble anionic detergent compounds are the ammonium and substituted ammonium (such as mono, di and tri-ethanolamine), alkali metal (such as, sodium and potassium) and alkaline earth metal (such as, calcium and magnesium) salts of the higher alkyl benzene sulfonates, olefin sulfonates and higher alkyl sulfates. Among the above-listed anionics, the most preferred are the sodium linear alkyl benzene sulfonates (LAS).

The nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergents include the polyethylene oxide condensate of 1 mole of alkyl phenol containing from about 6 to 12 carbon atoms in a straight or branched chain configuration with about 5 to 30 moles of ethylene oxide, for example, nonyl phenol condensed with 9 moles of ethylene oxide; dodecyl phenol condensed with 15 moles of ethylene oxide; and dinonyl phenol condensed with 15 moles of ethylene oxide. Condensation products of the corresponding alkyl thiophenols with 5 to 30 moles of ethylene oxide are also suitable.

The polar nonionic detergents useful in the present invention are those in which the hydrophilic group contains a semi-polar bond directly between two atoms, for example N→O, P→O, As→O, and S→O. Such polar nonionic detergents include:

1. Open-chain aliphatic amine oxides of the general formula $R_1R_2R_3N\rightarrow O$ wherein $R_1$ is an alkyl, alkenyl, or monohydroxyalkyl group containing from about 10 to 18 carbon atoms, and $R_2$ and $R_3$ are each an alkyl or monohydroxyalkyl group containing from 1 to 3 carbon atoms.
2. Open-chain aliphatic phosphine oxides having the general formula $R_1R_2R_3P\rightarrow O$, wherein $R_1$ is an alkyl, alkenyl or monohydroxyalkyl group containing from about 10 to 18 carbon atoms, and $R_2$ and $R_3$ are each an alkyl or monohydroxyalkyl group containing from 1 to 3 carbon atoms.
3. Surfactants having the general formula

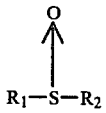

wherein $R_1$ is an alkyl group containing from about 10 to 18 carbon atoms, and $R_2$ is an alkyl group containing from 1 to 3 carbon atoms and from 0 to 2 hydroxyl groups.

Of the above-described types of nonionic surfactants, those of the ethoxylated alcohol type are preferred. Particularly preferred nonionic surfactants include the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol, the condensation product of a secondary fatty alcohol containing about 11–15 carbon atoms with about 9 moles of ethylene oxide per mole of fatty alcohol and condensation products of more or less branched primary alcohols, whose branching is predominantly 2-methyl, with from about 4 to 12 moles of ethylene oxide.

Zwitterionic detergents such as the betaines and sulfobetaines having the following formula are also useful:

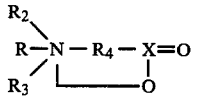

wherein R is an alkyl group containing from about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:O, the detergent is called a sulfobetaine or sultaine. Preferred betaine and sulfobetaine detergents are 1-(lauryl dimethylammonio) acetate, 1-(myristyl dimethylammonio) propane-3-sulfonate, and 1-(myristyl dimethylammonio)-2-hydroxy-propane-3-sulfonate.

Cationic surface active agents may also be employed. They comprise surface active detergent compounds which contain an organic hydrophobic group and a cationic solubilizing group. Typical cationic solubilizing groups are amine and quaternary groups.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2-aminoethyl myristyl amine; amide-linked amine such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atom is an alkyl group containing about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyl-dimethyl-stearyl-ammonium chloride, trimethyl-stearyl ammonium chloride, trimethyl-cetyl ammonium bromide, dimethyl-ethyl-lauryl ammonium chloride, dimethyl-propyl-myristyl ammonium chloride, and the corresponding methosulfates and acetates.

Ampholytic detergents are also suitable for the invention. Ampholytic detergents are well known in the art and many operable detergents of this class are disclosed by A. M. Schwartz, J. W. Perry and J. Birch in "Surface Active Agents and Detergents," Interscience Publishers, New York, 1958, vol. 2. Examples of suitable amphoteric detergents include: alkyl beta-aminodipropionates, $RN(C_2H_4COOM)_2$; alkyl beta-amino propionates, $RN(H)C_2H_4COOM$; and long chain imidazole derivatives having the general formula:

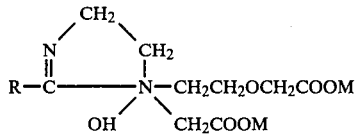

wherein in each of the above formulae R is an acyclic hydrophobic group containing from about 8 to 18 carbon atoms and M is a cation to neutralize the charge of the anion. Specific operable amphoteric detergents include the disodium salt of lauroycycloimidinium-1 ethoxyethionic acid-2-ethionic acid, dodecyl beta alanine, and the inner salt of 2-trimethylamino lauric acid.

The bleaching and laundering compositions of the invention optionally contain a detergency builder of the type commonly added to detergent formulations. Useful builders include any of the conventional inorganic and organic water-soluble builder salts. Useful inorganic builder salts include, for example, water-soluble salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1,1-disphosphonic acid and the sodium and potassium salts of ethane-1,1, 2-triphosphonic acid. Examples of these and other phosphorous builder compounds are disclosed in U.S. Pat. Nos. 3,213,030; 3,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium polyacetates, carboxylates, polycarboxylates and polyhydroxysulfonates are useful builders for the compositions and processes of the invention. Specific examples of polyacetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

Water-insoluble builders may also be used, particularly, the complex silicates and more particularly, the complex sodium alumino silicates such as zeolites, e.g., zeolite 4A, a type of zeolite molecular sieve wherein the univalent cation is sodium and the pore size is about 4 Angstroms. The preparation of such type zeolite is described in U.S. Pat. No. 3,114,603. The zeolites may be amorphous or crystalline and have water of hydration as known in the art.

The use of inert, water-soluble filler salt is desirable in both the bleaching and laundering compositions of the invention. The filler salt employed should preferably be free of any halide anion, and not ionize in aqueous media to chloride or bromide anions because of the possible deleterious effects of such halide anion on the bleaching activity of the bleach composition. A preferred filler salt is an alkali metal sulfate, such as, potassium or sodium sulfate, the latter being especially preferred.

The bleaching compositions of the invention are prepared by admixing the ingredients. When preparing laundering compositions containing the bleaching composition in combination with a detergent and/or builder salts, the peroxygen compound and activator can be mixed either directly with the detergent compound, builder and the like, or the peroxygen compound and activator can be separately or collectively coated with a coating material to prevent premature activation of the bleaching agent. The coating process is conducted in accordance with procedures well known in the art. Suitable coating material include compounds such as magnesium sulfate, polyvinyl alcohol lauric acid or its salts, and the like.

TEST PROCEDURE

Bleaching tests were carried out on standard stained test swatches (described below) using the various bleaching and laundering compositions described in the Examples in a Tergotometer vessel manufactured by the U.S. Testing Company. The Tergotometer was maintained at a constant temperature of 120° F. and operated at 100 rpm.

Each of the test compositions (except where specifically indicated to the contrary) was added to one liter of tap water at 120° F. having a water hardness of about 100 ppm, as calcium carbonate. The test compositions were agitated for about one minute and then a mixed fabric load consisting of two swatches each (3"×4") of the stained fabrics described below was added to each wash receptacle. After a 15 minute wash at 120° F., the test fabrics were rinsed under 100° F. tap water and dried on a print dryer. The percent stain removal was measured by taking a reflectance reading for each test swatch prior to and after the bleaching test using a Gardner Color Difference Meter, and the percent stain removal (% S.R.) was calculated as follows:

$$\% \, S.R. = \frac{(Rd \text{ after washing}) - (Rd \text{ before washing})}{90 - (Rd \text{ before washing})}$$

A difference greater than 2% in the average of the five stained cloths tested is considered significant.

At the end of each wash, the active oxygen content of the wash solution was determined by acidification with dilute sulfuric acid followed by treatment of the wash solution with potassium iodide and a minor amount of ammonium molybdate, and thereafter titration with standardized sodium thiosulfate using starch as the indicator.

The respective stains and test swatches were as follows:

| | Stain | Test Cloth |
|---|---|---|
| 1. | Grape | 65 Dacron - 35 Cotton |
| 2. | Blueberry | Cotton |
| 3. | Sulfo Dye | EMPA 115 |
| 4. | Red Wine | EMPA 114 |
| 5. | Coffee/Tea | Cotton |

Stained test cloths 1 and 2 are prepared by passing rolls of unsoiled fabric through a padding and drying apparatus (manufactured by Benz of Zurich, Switzerland) containing either grape or blueberry solutions at 90° F. After drying at 250° F., the fabric is cut into 3"×4" swatches. Eighty of these swatches, impregnated with the same stain, are rinsed in 17 gallons of 85° F. water in an automatic home washer. They are then dried by a passage through a Beseler Print Dryer at a machine temperature setting of 6 and a speed of 10.

Stained fabrics 3 and 4 are purchased from Testfabrics Incorporated of Middlesex, New Jersey, and cut into 3"×4" swatches.

Stained fabric 5 is prepared by agitating and soaking unsoiled cotton strips (18"×36") in a washing machine filled with a solution of coffee/tea (8:1 weight ratio) at 150° F. The machine is allowed to rinse-spin dry to remove the coffee/tea solution. The stained fabric is then machine washed twice with hot pyrophosphate-surfactant solution followed by two complete water wash cycles at 140° F. The strips are then dried by two passes through an Ironrite machine set at 10 and then cut into 3"×4" swatches.

EXAMPLE 1

A granular detergent composition (designated herein as "HDD") was prepared by conventional spray-drying and had the following approximate composition:

| Composition | Weight Percent |
|---|---|
| Sodium tridecylbenzenesulfonate | 15 |
| Ethoxylated $C_{12}$–$C_{15}$ primary alcohol (7 moles EO/mole alcohol) | 1 |
| Sodium tripolyphosphate | 33 |
| Sodium carbonate | 5 |
| Sodium silicate | 7 |
| Sodium carboxymethylcellulose | 0.5 |
| Optical brighteners | 0.2 |
| Perfume | 0.2 |
| Water | 11 |

-continued

| Composition | Weight Percent |
|---|---|
| Sodium sulfate | balance |

Detergent compositions A–E containing HDD were formulated as set forth below in Table I. To assure good dissolution of the phthalic anhydride in the aqueous wash solution, the phthalic anhydride is finely ground to pass through a Number 20 U.S.A. Standard Sieve, and more preferably, through a Number 60 U.S.A. Sieve.

TABLE I

| Component | Composition A | B | C | D | E | F |
|---|---|---|---|---|---|---|
| Detergent, HDD | 1.50g | 1.50g | 1.50g | 1.50g | 1.50g | 1.50g |
| Sodium perborate (10.1% A.O.) | 0.10 | 0.10 | 0.10 | 0.10 | 0.10 | 0.10 |
| DTPMP(1) | 0.02 | — | 0.02 | — | — | — |
| Phthalic anhydride | — | 0.14 | 0.14 | 0.14 | 0.14 | 0.14 |
| Sodium carbonate | — | — | 0.05 | — | — | 0.05 |
| EDTA(2) (disodium salt) | — | — | — | 0.02 | — | — |
| NTA(3) | — | — | — | — | .020 | .020 |

(1)Sodium diethylene triamine pentamethylene phosphonate
(2)Ethylene diamine tetraacetic acid, disodium salt
(3)Nitrilotriacetic acid, trisodium salt - monohydrate.

Compositions A through F were tested in accordance with the procedure described above and the results of the bleaching tests are tabulated in Table II which sets forth the initial and final values of the active oxygen (A.O.) in the wash solution (expressed as "initial grams" and "residual grams", respectively) and the stain removal achieved for each of the 5 stains.

TABLE II

Comparative Bleaching Performance

| | Composition A | B | C | D | E | F |
|---|---|---|---|---|---|---|
| Initial grams (A.O. × $10^3$) | 10.1 | 10.1 | 10.1 | 10.1 | 10.1 | 10.1 |
| Residual grams (A.O. × $10^3$) | 9.2 | 5.3 | 6.8 | 5.5 | 6.0 | 5.7 |
| Stain removal: | % | % | % | % | % | % |
| Grape | 52 | 72 | 69 | 68 | 72 | 62 |
| Blueberry | 45 | 48 | 50 | 51 | 52 | 48 |
| Sulfodye (EMPA 115) | 4 | 4 | 4 | 4 | 3 | 3 |
| Red wine (EMPA 114) | 30 | 40 | 36 | 39 | 38 | 35 |
| Coffee/Tea | 14 | 38 | 34 | 37 | 39 | 33 |
| Avg. (%) | 29 | 40 | 39 | 40 | 41 | 36 |

The results of Table II indicate that composition C, a composition in accordance with the invention, consumes less active oxygen while providing about an equivalent level of stain removal relative to composition B, a composition essentially similar to composition C except that it contains no DTPMP, and compositions D, E and F which differ from composition C in that they employ either EDTA or NTA as chelating agents rather than DTPMP.

EXAMPLE 2

Compositions B and C described in Table I above were tested in accordance with the test procedure of Example I except that the hardness of the wash water was 300 ppm, expressed as $CaCo_3$, instead of 100 ppm. The wash water used was tap water to which 200 ppm of hardness derived from calcium and magnesium chloride was added. The results of the bleaching tests are shown in Table III.

TABLE III

| Comparative Bleaching Performance | B | C |
|---|---|---|
| Initial grams (A.O. × $10^3$) | 10.1 | 10.1 |
| Residual grams (A.O. × $10^3$) | 5.0 | 5.8 |
| Stain Removal | % | % |
| Grape | 77 | 77 |
| Blueberry | 54 | 52 |
| Sulfodye (EMPA 115) | 2 | 2 |
| Red Wine (EMPA 114) | 40 | 40 |
| Coffee/Tea | 45 | 43 |
| Avg. (%) | 44 | 43 |

A comparison of the bleaching performance achieved with compositions B and C in this Example with the bleaching performance of Compositions B and C in Example 1 (Table II) indicates that a substantially improved stain removal efficiency was achieved in water having a 300 ppm hardness content relative to the 100 ppm water of Example 1.

EXAMPLE 3

Detergent compositions G and H were formulated as shown below.

| Component | Composition G | Composition H |
|---|---|---|
| Detergent, HDD | 1.50g | 1.50g |
| Sodium perborate | 0.10 | 0.10 |
| Phthalic anhydride (P.A.) | 0.10(1) | — |
| TAED(2) | — | 0.045(3) |
| DTPMP | 0.02 | 0.02 |

(1)Perborate: P.A. mole ratio = 1
(2)Tetraacetyl ethylenediamine
(3)Perborate: TAED mole ratio = 3

Compositions G and H were tested under the wash conditions of Example 1 (100 ppm water) and Example 2 (300 ppm water). The results are summarized in Table IV.

TABLE IV

| Comparative Bleaching Performance In 100 And 300 ppm Water Hardness | 100 ppm Hardness G | 100 ppm Hardness H | 300 ppm Hardness G | 300 ppm Hardness H |
|---|---|---|---|---|
| Initial grams (A.O. × $10^3$) | 10.1 | 10.1 | 10.1 | 10.1 |
| Final Grams (A.O. × $10^3$) | 7.7 | 8.0 | 6.9 | 7.4 |
| Stain Removal | % | % | % | % |
| Grape | 66 | 73 | 74 | 63 |
| Blueberry | 51 | 53 | 53 | 44 |
| Red wine (EMPA 114) | 34 | 33 | 36 | 28 |
| Avg. (%) | 50 | 53 | 54 | 45 |

As evident from Table IV, in water of 100 ppm hardness, the detergent composition of the invention activated with phthalic anhydride (composition G) is nearly as effective for bleaching as the detergent composition activated with TAED (composition H). In water of 300 ppm hardness, the TAED activated perborate composition is markedly less effective than composition G, the composition of the invention.

What is claimed is:

1. A bleaching and laundering composition comprising a peroxygen compound, an activator for said peroxygen compound consisting essentially of phthalic anhydride, and diethylene triamine pentamethylene phosphonic acid and/or a water-soluble salt thereof.

2. A composition in accordance with claim 1 wherein the peroxygen compound is an alkali metal perborate.

3. A composition in accordance with claim 1 wherein the peroxygen compound is an alkali metal percarbonate.

4. A composition in accordance with claim 1 which additionally contains a surface active agent selected from the group consisting of anionic, nonionic, cationic, ampholytic and zwitterionic detergents.

5. A bleaching detergent composition comprising:

(a) from about 5 to 50%, by weight, of a composition consisting essentially of a peroxygen compound, phthalic anhydride as an activator therefor, and diethylene triamine pentamethylene phosphonic acid and/or a water-soluble salt thereof;

(b) from about 5 to 50%, by weight, of a detergent surface active agent;

(c) from about 1 to 60%, by weight, of a detergent builder salt; and, (d) the balance comprising water and optionally filler salts.

6. A bleaching detergent composition in accordance with claim 5 wherein said peroxygen compound is an alkali metal perborate, and said surface active agent is selected from the group consisting of anionic, nonionic, cationic, ampholytic and zwitterionic detergents.

7. A process for bleaching which comprises contacting the stained and/or soiled material to be bleached with an aqueous solution of a composition comprising a peroxygen compound, an activator for said peroxygen compound consisting essentially of phthalic anhydride and diethylene triamine pentamethylene phosphonic acid and/or a water-soluble salt thereof.

8. The process of claim 5 wherein the peroxygen compound is an alkali metal perborate.

9. The process of claim 5 wherein the peroxygen compound is an alkali metal percarbonate.

10. The process of claim 5 wherein said composition additionally contains a surface active detergent selected from the group consisting of anionic, nonionic, cationic, ampholytic and zwitterionic detergents.

11. A process for manufacturing the composition of claim 5 which comprises:

(a) forming an aqueous slurry containing said detergent surface active agent and said detergent builder salt;

(b) spray-drying said aqueous slurry to form granular particles thereof; and, (c) adding the composition consisting essentially of (i) a peroxygen compound, (ii) phthalic anhydride, and (iii) diethylene triamine pentamethylene phosphonic acid and/or a water-soluble salt thereof to the granular particles formed in step (b) to form the finished bleaching detergent composition.

* * * * *